United States Patent [19]

Choi et al.

[11] 4,424,121

[45] Jan. 3, 1984

[54] SELECTIVE REMOVAL OF NITROGEN-CONTAINING COMPOUNDS FROM HYDROCARBON MIXTURES

[75] Inventors: Henry W. Choi, Irvine; Martin B. Dines, Laguna Beach, both of Calif.

[73] Assignee: Occidental Research Corporation, Irvine, Calif.

[21] Appl. No.: 403,925

[22] Filed: Jul. 30, 1982

[51] Int. Cl.[3] ..... C10G 21/00; C10G 21/06

[52] U.S. Cl. ..... 208/254 R; 585/845; 585/848; 585/864; 585/868

[58] Field of Search ..... 208/254 R; 585/845, 585/848, 855, 864, 868

[56] References Cited

U.S. PATENT DOCUMENTS

| | | | |
|---|---|---|---|
| 2,744,855 | 5/1956 | Arnold | 196/32 |
| 2,796,387 | 6/1957 | Schmidt | 196/32 |
| 2,970,105 | 1/1961 | Condo et al. | 208/295 |
| 3,193,496 | 7/1965 | Hartung | 208/212 |
| 3,223,618 | 12/1965 | Convery et al. | 208/247 |
| 3,317,420 | 5/1967 | Gatsis | 208/264 |
| 3,326,798 | 6/1967 | Hess | 208/254 R |
| 4,071,435 | 1/1978 | Smith | 208/91 |
| 4,272,361 | 6/1979 | Compton | 208/254 R |
| 4,329,222 | 5/1982 | Hobeeb | 208/254 R |

*Primary Examiner*—Delbert E. Gantz
*Assistant Examiner*—Anthony McFarlane
*Attorney, Agent, or Firm*—Christie, Parker & Hale

[57] ABSTRACT

A method is disclosed for reducing the nitrogen content of hydrocarbon liquids. The method comprises contacting the hydrocarbon liquid with a solid metal salt capable of selectively extracting nitrogen-containing compounds from the hydrocarbon liquid to thereby form a nitrogen-rich solid extract. Nitrogen-lean hydrocarbon liquid is then separated from the solid extract. The solid extract is washed with a solvent capable of selectively dissolving non-nitrogen-containing compounds entrained in the solid extract. The solid extract is then treated with a release agent for selectively dissolving nitrogen-containing compounds to thereby recover the metal salt. The presently preferred metal salt is cupric chloride.

37 Claims, No Drawings

SELECTIVE REMOVAL OF NITROGEN-CONTAINING COMPOUNDS FROM HYDROCARBON MIXTURES

BACKGROUND OF THE INVENTION

The process herein relates to reducing the nitrogen content of shale oil by contacting the shale oil with a solid metal salt capable of extracting nitrogen-containing compounds from shale oil.

The term "oil shale" as used in the industry refers to a sedimentary formation comprising marlstone deposits with layers containing an organic polymer called "kerogen" which, upon heating, decomposes to produce liquid and gaseous products. The formation containing kerogen is called "oil shale" herein and the liquid product produced upon decomposition of kerogen is called "shale oil".

In a preferred practice of the method described herein, the method is utilized for refining shale oil produced from in situ retorting of oil shale. An in situ oil shale retort can be formed by many methods, such as the methods disclosed in U.S. Pat. Nos. 3,661,423; 4,043,595; 4,043,596; 4,043,597; and 4,043,598, all of which are incorporated herein by this reference.

Although the process disclosed herein of reducing the nitrogen content of shale oil is primarily discussed in relation to shale oil produced from the in situ retorting of oil shale, the process can be practiced on shale oil produced by other methods of retorting. Many of these methods for shale oil production are described in Synthetic Fuels Data Handbook, compiled by Dr. Thomas A. Hendrickson, and published by Cameron Engineers, Inc., Denver, Colorado. For example, other processes for retorting oil shale include those known as the TOSCO Paraho Direct, Paraho Indirect, N-T-U, the Bureau of Mines, Rock Springs, processes.

Kerogen is considered to have been formed by the deposition of plant and animal remains in marine and nonmarine environments. Its formation is unique in nature. Alteration of this deposited material during subsequent geological periods produced a wide variety of organic materials. Source material and conditions of deposition were major factors influencing the type of final product formed.

Kerogen samples, found in various parts of the world, have nearly the same elemental composition. However, kerogen can consist of many different compounds having differing chemical structures. Some compounds found in kerogen have the structures of proteins while some have structures of terpenoids, and others have structures of asphalts and bitumens.

Shale oils are generally high molecular weight, viscous organic liquids, of predominantly hydrocarbonaceous oxygen, nitrogen and sulfur-containing organic compounds produced from oil shale. The shale oils are of varying linear, branched cyclic, aromatic hydrocarbon and substituted hydrocarbon content with high pour points, moderate sulfur content and relatively high nitrogen content. The shale oil produced from an oil shale formation can vary between strata within the oil shale formation. The nitrogen content of shale oil can also vary dependent upon the geographical location of the oil shale deposit from which the shale oil is produced. Such a variance in nitrogen content in different geographical locations can be attributed to differences in the environment during the time of the deposition of the organisms which, upon lithification, become oil shale. Such a variance can also be attributed to the different types of organisms in the separate geographical locations which were deposited to form the organic substance in the oil shale and any organisms within the formed deposit layer which acted upon such deposited material to provide the kerogen within the oil shale formation. Furthermore, the nitrogen content of shale oil may vary according to the process and operating variables used to produce it.

The nitrogen content in shale oil is attributable to basic nitrogen-containing compounds and non-basic nitrogen-containing compounds. The relative percentages of the basic and non-basic nitrogen compounds comprising the total nitrogen content of a shale oil varies depending upon the particular shale oil but typically are in the ranges of 60% to 70% basic nitrogen-containing compounds and 30% to 40% non-basic nitrogen-containing compounds.

The nitrogen content of shale oil is generally up to about 2% by weight. For example, the average nitrogen content of shale oil recovered by in situ retorting of oil shale from the Piceance Creek Basin of Western Colorado is on the order of about 1.4% by weight. This is very high when compared with the nitrogen content of crude petroleum which is typically up to about 0.3% by weight.

The presence of nitrogen in shale oil presents many problems in that the nitrogen can interfere with the transportation and use of the shale oil. Deleterious effects brought about by the presence of nitrogen in shale oil are decreased catalyst life in hydrogenation, reforming, hydrocracking and catalytic cracking reactions, decreased chemical stability of products, and decreased color stability of products.

Another problem with the presence of nitrogen in shale oil is that it is undesirable to transport nitrogen-containing shale oil through pipelines which are also used for transporting petroleum products because of possible contamination of such products with residual nitrogen-containing shale oil in the pipeline. Generally such petroleum products contain a very low nitrogen content. The relatively high nitrogen content in the shale oil can pollute the pipelines, making them undesirable and uneconomical for transporting such low nitrogen-containing petroleum products. In addition, high nitrogen content in shale oil can cause clogging of pipelines due to self-polymerization brought about by the reactivity of the nitrogen-containing compounds. Due to the basicity of the nitrogen-containing compounds in shale oil, some corrosion can occur, thus damaging a pipeline used to transport shale oil.

Product stability is a problem that is common to many products derived from shale oil with the major exception of the asphalt cut and those products that have undergone extensive hydrotreating. Such instability, including photosensitivity, is believed to result primarily from the presence of nitrogen-containing compounds.

It is, therefore, desirable to reduce the nitrogen content of shale oil to increase the utility, transportability, and stability of the shale oil and the products derived from such shale oil.

Due to the undesirable nature of nitrogen in organic fluid streams, such as fluid streams produced in the recovery and refining of petroleum and shale oil, many processes have been developed to reduce the nitrogen content to an acceptable level.

A variety of liquid extraction processes have been used to reduce the nitrogen content of such a fluid stream. Processes have also been disclosed in which the extraction agent is a solid compound.

In extraction processes, the shale oil is contacted with an extraction agent, usually an immiscible solvent capable of selectively extracting nitrogen-containing compounds. As illustrative, U.S. Pat. No. 4,272,361 to Compton discloses a method for reducing the nitrogen content of shale oil by contact with a solvent comprising an active solvent for nitrogen-containing compounds and sufficient water to provide phase separation. The active solvent is selected from the group consisting of organic acids and substituted organic acids.

U.S. Pat. No. 2,744,855 to Arnold discloses the use of Friedel-Crafts halides in combination with liquid sulfur dioxide to remove nitrogen and sulfur from hydrocarbon liquids.

U.S. Pat. No. 2,970,105 to Condo et al discloses the addition of an anhydrous metallic halide wherein the metal is selected from the group consisting of antimony, tin, iron, aluminum, silicon, zinc and titanium to a hydrocarbon liquid to remove nitrogen-containing compounds followed by filtration of the solids formed. A small amount of water is then added to form additional precipitates which are then separated. Titanium tetrachloride is the preferred anhydrous metallic halide.

U.S. Pat. No. 2,796,387 to Schmidt discloses a process for reducing the nitrogen content of an oil using small amounts of various Friedel-Crafts halides ($BF_3$, $AlCl_3$, $FeCl_3$, etc.) in conjunction with a nonacid polar solvent such as sulfur dioxide. The Friedel-Craft halides form sludge-like precipitates with impurities in the oil and addition of the solvent frees the oil from the precipitate.

U.S. Pat. No. 3,223,618 to Convery et al discloses the use of zinc chloride as a solid to remove impurities, including nitrogen-containing compounds, from an oil. A temperature of from 250° C. to 500° C. is required.

The U.S. Pat. No. 3,317,420 to Gatsis discloses a method for reducing the nitrogen content of a hydrocarbon liquid by colloidally dispersing a tin salt in the hydrocarbon liquid at a temperature above 225° C.

The U.S. Pat. No. 3,193,496 to Hartung discloses contacting a mixture of iron and zinc salts with a petroleum fraction to remove nitrogen-containing compounds from the fraction. The salts may be recovered by thermally decomposing the formed metal salt complexes at temperatures between 225° C. and 600° C. or by oxidative regeneration. The salts may be washed with a low molecular weight aliphatic hydrocarbon to remove residual amounts of treated charge stock adhering to the salts prior to regeneration.

U.S. Pat. No. 4,071,435 to Smith teaches the use of aqueous solutions of halides of zinc, cadmium, mercury, lead, and copper to extract nitrogen-containing compounds from a syncrude feed.

Many of these processes involve metal salts in solutions or used in conjunction with a liquid. This requires the use of special liquid-liquid separation techniques. Many of the processes do not address themselves to the special problems associated with shale oil, which has a very high nitrogen content. In addition, some of these processes require elevated temperatures. In all of the processes, regeneration of the extracting agent is difficult. Accordingly, there is a need for a simpler method for removing nitrogen-containing compounds from shale oil.

SUMMARY

There is provided a method for reducing the nitrogen content of a hydrocarbon liquid, particularly shale oil. The method comprises contacting the hydrocarbon liquid with a solid metal salt capable of selectively extracting nitrogen-containing compounds from the hydrocarbon liquid, preferably selected from the group consisting of cobalt molybdate, cobalt metaborate, the phosphate and phosphate derivatives of zirconium and the copper II exchanged counterparts thereof, the halides of copper, nickel, cobalt, manganese, chromium, vanadium, niobium, zirconium, molybdenum, thorium and uranium, and the nitrates, sulfates, tetrafluoroborates, and the substituted and non-substituted acetates, carboxylates, and acetylacetonates of copper, zinc, nickel, cobalt, iron, manganese, chromium, vanadium, niobium, zirconium, molybdenum, thorium and uranium, at a temperature of from about 20° C. to about 80° C. The presently preferred metal salt is cupric chloride.

The contact time is sufficient for the metal salt to extract at least a portion of the nitrogen-containing compounds from the hydrocarbon liquid. The hydrocarbon liquid is then separated from the solid extract, preferably by decanting.

In a preferred embodiment, shale oil is the hydrocarbon liquid and is contacted with a solid metal salt capable of selectively extracting nitrogen-containing compounds from shale oil for a time sufficient to form a nitrogen-lean raffinate and a solid nitrogen-enriched extract. The raffinate is then separated from the extract, preferrably by decanting.

The separated extract is washed with a solvent capable of selectively dissolving non-nitrogen-containing compounds to thereby form a solvent wash containing solvent and non-nitrogen-containing compounds entrained by the solid extract and a solid phase containing the metal salt and nitrogen-containing compounds. The solvent wash and the solid phase are separated. The solvent is recovered from the solvent wash as the distillate of a simple distillation. The residue of the distillation is composed of non-nitrogen-containing compounds and is added to the raffinate to maximize oil recovery.

The solid phase is then treated with a release agent to recover the metal salt. Preferably the release agent is capable of selectively dissolving nitrogen-containing compounds which generates a liquid phase including the release agent and nitrogen-containing compounds and a solid phase comprising the metal salt. The two phases are then separated. The release agent can then be recovered from distillate in a simple distillation.

Alternatively, the release agent is capable of selectively dissolving the metal salt to form two liquid phases, a first phase containing the release agent and dissolved metal salts and a second phase of the nitrogen-containing compounds. The two phases are then separated and the metal salts recovered by evaporating the release agent.

DETAILED DESCRIPTION

In accordance with the invention, there is provided a process for the removal of nitrogen-containing compounds from a hydrocarbon liquid. The process is particularly applicable to reducing the nitrogen content of crude or processed shale oil.

As used herein, the term "crude shale oil" refers to the liquid product that is recovered from retorting of oil shale. The term encompasses liquid products formed during surface retorting processes or in situ oil shale retorting processes, which products have not undergone any further processes other than water removal or emulsion breaking. The term "processed shale oil" is used herein to indicate a crude shale oil which has undergone some processing, such as, for example, sulfur removal, fractionation, and the like.

In a preferred embodiment of the invention, the process comprises mixing crude or processed shale oil with at least one solid metal salt capable of selectively removing nitrogen-containing compounds from shale oil. The crude or processed shale oil is mixed with the metal salt for a time sufficient for at least a portion of the nitrogen-containing compounds to be extracted by the metal salt.

Metal salts capable of selectively extracting nitrogen-containing compounds include cobalt molydate, the phosphate and phosphate derivatives of zirconium and the copper II exchanged counterparts thereof, and salts having a cation selected from the group consisting of copper, zinc, nickel, cobalt, iron, manganese, chromium, vanadium, zirconium, molybdenum, thorium, niobium and uranium and an anion selected from the group consisting of halides, nitrate, sulfate, acetate, carboxylate, acetylacetonate and tetrafluorborate. Hydrated salts as well as anhydrous salts can be used.

As used herein, "phosphate derivatives" of zirconium refers to a compound of the formula $Zr(O_3PR)_2$ wherein R is independently an organic functional group. For example, effective functional groups include the groups ($CH_2CH_2CO_2H$) and ($CH_2CH_2CH_2SO_3H$).

The presently preferred metal salt is cupric chloride having a hydration number between 0 and 2; i.e., $CuCl_2.xH_2O$ where x is from 0 to 2. Cupric chloride is preferred because it has exhibited the greatest extraction capacity and the highest efficiency, i.e., fastest extraction rate. In addition, the extract that is produced is easily separated from the raffinate.

While not being bound by theory, it is believed that the nitrogen-containing compounds form coordination complexes with the metal cation of the salts and that the metal salts actually absorb the nitrogen-containing compounds, i.e., the crystal lattice structure of the metal salt particles is altered sufficiently to enable nitrogen-containing compounds to penetrate and therefore be absorbed by the metal salt particles. This characteristic enhances the capacity of the metal salt for reacting with and retaining nitrogen-containing compounds.

The metal salt may be in any shape or form, from powders to large rock-size particles of one-half inch diameter and more. Smaller size metal salt particles offer the advantage that they provide a large surface area per unit weight and therefore provide a faster rate of extraction of the nitrogen-containing compounds. However, small particles tend to be more difficult to separate from hydrocarbon liquids and also tend to entrain more non-nitrogen-containing compounds than larger particles.

Larger particles, while being easier to separate from hydrocarbon liquids, have a smaller surface area per unit weight than smaller particles and thus, while having about the same capacity for the extraction of nitrogen-containing compounds, tend to exhibit a slower extraction rate.

The amount of the metal salt that is mixed with the shale oil is dependent upon the amount of nitrogen-containing compounds in the shale oil and is preferably sufficient to reduce the nitrogen content of the shale oil to a level sufficiently low to enable the shale oil to be processed by conventional crude petroleum processes. Generally, crude petroleum contains no more than about 3,000 ppm nitrogen and typically no more than about 2,000 ppm nitrogen. The amount of metal salt is therefore sufficient to reduce the nitrogen content of the shale oil to no more than about 3,000 ppm, and preferably to no more than about 2,000 ppm.

To react with and thereby extract nitrogen-containing compounds, there must be contact between the nitrogen-containing compounds in the shale oil and the metal salts. To provide sufficient contact with the solid metal salt, the metal salt is formed into a bed over which the shale oil passes or through which the shale oil percolates.

Alternatively, and preferably, the mixture of metal salt and shale oil is agitated to enhance contact of the nitrogen-containing compounds with the metal salts. Agitation keeps the metal salts suspended in the hydrocarbon liquid which maximizes the effective surface area of the metal salts and also reduces the distance that nitrogen-containing compounds must diffuse through the shale oil to contact the metal salts. Agitation may be by any conventional means, such as air or mechanical agitation.

Contact time may range from as little as one second to as much as several hours or days, depending upon the relative amount of nitrogen-containing compounds and metal salts, the effective surface area of the metal salts and the time required for the nitrogen-containing compounds in the shale oil to contact and react with the metal salts. Shorter contact times are preferred.

The time required for the nitrogen-containing compounds to contact the metal salts depends not only on the amount of agitation of the mixture but also on the temperature at which the extraction is carried out as this affects the viscosity of the shale oil. A shale oil feed having a lower viscosity generally requires a shorter contact time because the diffusion rates of nitrogen-containing compounds in the shale oil generally increases with reduced viscosity. The extraction is preferably operated at a temperature of from about 20° C. to about 80° C. For shale oil feeds having a high viscosity, it is preferred that the extraction be carried out at a temperature in the upper part of the range, i.e., from about 60° C. to about 80° C. Alternatively, the shale oil feed may be diluted with a solvent to reduce its viscosity.

Contact between the shale oil and the metal salts, which react with and thereby extract nitrogen-containing compounds from the shale oil, produces a nitrogen-lean shale oil raffinate and a nitrogen-rich solid extract. The solid extract is then separated from the shale oil raffinate. The solid extract can be separated from the shale oil raffinate by conventional separation techniques including gravity settling, filtration methods, and centrifugal separations, e.g., using a cyclone. The method chosen depends on various factors, including the particle size of the metal salts and the viscosity of the shale oil raffinate. A solvent may be added to the shale oil raffinate to reduce its viscosity for the purpose of decreasing the time required for the separation of the solid extract from the shale oil raffinate.

It is presently preferred that the shale oil raffinate be separated from the solid extract which comprises the solid metal salts and nitrogen-containing compounds by decanting, i.e., pouring off the upper liquid shale oil raffinate phase from the settled solid extract phase.

Decanting is preferred because this method requires a relatively short period of time to complete the separation and does not require costly equipment or facilities.

The extraction can also be carried out in two or more stages. In such a process, the shale oil feed is contacted with a first amount of metal salt. The raffinate that is formed, having a reduced nitrogen content, is separated from the formed extract and then contacted with a second quantity of metal salt. This results in a second raffinate having a further reduced nitrogen content and a second extract. The second raffinate is then separated from the extract.

The solid extract phase remaining after the shale oil raffinate has been decanted contains desirable shale oil compounds, i.e., non-nitrogen-containing compounds, entrained by the solid extract. To recover the desirable shale oil compounds, the solid extract phase is preferably washed with a solvent capable of selectively dissolving non-nitrogen-containing compounds without dissolving a significant amount of nitrogen-containing compounds.

Solvents capable of selectively dissolving non-nitrogen-containing compounds are generally non-polar solvents having a dielectric constant up to about 2. Solvents having a dielectric constant above about 2 tend to dissolve a significant portion of the nitrogen-containing compounds. The presently preferred solvent is pentane.

The amount of solvent that is used is sufficient to solubilize substantially all of the non-nitrogen-containing hydrocarbons to thereby form a solvent wash, containing solvent and dissolved non-nitrogen-containing compounds, and a solid extract consisting essentially of nitrogen-containing compounds and the metal salt. After the solvent has contacted the solid extract phase for a time sufficient to dissolve substantially all of the non-nitrogen-containing hydrocarbons, the solvent wash is separated from the solid extract, preferably by decanting.

The solvent is recovered from the solvent wash, preferably by a simple distillation. In such a distillation, the solvent wash is heated sufficiently to vaporize the solvent without vaporizing a significant portion of the non-nitrogen-containing compounds. The vaporized solvent is then condensed to form a solvent distillate. The solvent distillate, which is substantially free of non-nitrogen-containing compounds, can be reused to recover similar, non-nitrogen-containing hydrocarbons from another high nitrogen solid extract phase.

The non-vaporized, non-nitrogen-containing compounds, which form the residue or bottoms of the distillation are combined with the nitrogen-lean shale oil raffinate. The non-nitrogen-containing compounds recovered by the solvent wash generally increases the shale oil recovery by up to about 20% with an average increase of about 15% having been found.

After the non-nitrogen-containing compounds have been removed from the solid extract phase, the remaining solid extract is treated with a release agent to remove the nitrogen-containing compounds from the metal salts and to thus recover the solid metal salts.

It is presently preferred that the solid extract is mixed with a release agent comprising an organic solvent capable of extracting and dissolving nitrogen-containing compounds from the metal salt without dissolving a significant portion of the metal salts. The amount of organic solvent is sufficient to dissolve substantially all of the nitrogen-containing compounds to thereby form a liquid phase consisting essentially of the solvent and nitrogen-containing compounds and a solid phase consisting of the metal salt. The liquid phase is decanted to recover the metal salt.

The liquid phase contains nitrogen-containing compounds and solvent. The solvent is recovered by passing the liquid phase to a distillation zone, wherein the solvent is distilled and recovered as distillate. Nitrogen-containing compounds remain as the residue or bottoms of the distillation which forms a high-nitrogen extract oil. The solvent that is recovered can be concentrated and recycled for use in a subsequent extraction to separate nitrogen-containing compounds from other metal salts.

It has been found that solvents capable of selectively extracting nitrogen-containing compounds from the solid extract generally have a dielectric constant of from about 2 to about 8 and include such solvents as tetrahydrofuran, toluene, acetic acid, methyl acetate and ethyl acetate. Solvents having dielectric constants less than about 2 are generally insufficiently polar to dissolve substantially all of the nitrogen-containing compounds. Solvents having a dielectric constant above about 8 tend to dissolve at least a portion of the metal salt, thereby reducing recovery of the metal salt.

An alternate treatment involves contacting the solid extract with a release agent comprising an aqueous solvent for the metal salt. The aqueous solvent selectively dissolves the metal salt to form a two-phase liquid mixture wherein the aqueous solvent and dissolved metal salts form an aqueous phase and the nitrogen-containing compounds form a high-nitrogen extract oil. The aqueous phase is then separated from the high-nitrogen extract oil by conventional liquid-liquid separation techniques, such as decanting the upper phase or withdrawing the lower phase.

The aqueous solvent is then removed from the dissolved metal salt, for example, by evaporation or distillation, to recover the metal salt. The recovered metal salts can be recycled to another extraction.

As a second alternative, the solid extract can be contacted with a two-phase liquid mixture generally having an aqueous solvent and an organic solvent in which the organic solvent selectively dissolves nitrogen-containing compounds and the aqueous solvent selectively dissolves the metal salts. The two phases are then separated by conventional liquid-liquid separation techniques.

The aqueous solvent is then removed, by evaporation or distillation, from the dissolved metal salt, thus regenerating the solid metal salt. The organic solvent can be recovered by a simple distillation.

The high-nitrogen extract oil can be used as a feedstock for hydrogen gas generation. Or, because of its high nitrogen content, the high-nitrogen extract oil can be used in the production of nitrogen compounds and various chemical intermediates containing nitrogen. The residue can also be used as an asphalt, which provides good adhesive properties because of its nitrogen content and ability to crosslink through nitrogen.

EXAMPLES 1–9

In Examples 1 to 8, 30 grams of shale oil having an average nitrogen content of 1.4% by weight was contacted in a beaker with a specified amount of granular cupric chloride having an average hydration number of about 1.5. The amount of cupric chloride along with the temperature and contact time were varied as indicated in Table 1. During the extraction, the mixture of shale oil and cupric chloride was mechanically agitated. The solid phase was allowed to settle and the raffinate was decanted and analyzed for its nitrogen content.

In Example 9, the granular cupric chloride was ground into a fine powder prior to contacting the shale oil. All other conditions were as indicated.

TABLE 1

| Example | Weight of Cupric Chloride (g) | Contact Time (min.) | Temperature (°C.) | Weight Percent of Nitrogen in Raffinate |
|---|---|---|---|---|
| 1 | 10 | 90 | 63 | 0.43 |
| 2 | 20 | 90 | 63 | 0.20 |
| 3 | 10 | 15 | 63 | 1.03 |
| 4 | 10 | 30 | 63 | 0.81 |
| 5 | 10 | 60 | 63 | 0.59 |
| 6 | 10 | 90 | 63 | 0.43 |
| 7 | 10 | 90 | 23 | 1.20 |
| 8 | 10 | 90 | 80 | 0.19 |
| 9 | 10 | 45 | 63 | 0.41 |

I claim:

1. A process for reducing the nitrogen content of hydrocarbon liquids comprising:

mixing a hydrocarbon liquid containing nitrogen-containing compounds with at least one solid metal salt selected from the group consisting of cobalt molybdate, cobalt metaborate, the halides of copper, nickel, cobalt, manganese, chromium, vanadium, niobium, zirconium, molybdenum, thorium and uranium, and the nitrates, sulfates and tetrafluoroborates of copper, nickel, cobalt, manganese, chromium, vanadium, niobium, zirconium, molybdenum, thorium and uranium for a time sufficient for at least a portion of the nitrogen-containing compounds to be extracted from the hydrocarbon liquid by the solid metal salt to thereby form a nitrogen-lean hydrocarbon liquid and a solid nitrogen-rich extract; and separating the solid nitrogen-rich extract from the nitrogen-lean hydrocarbon liquid.

2. A process as claimed in claim 1 wherein the solid metal salt comprises cupric chloride.

3. A process as claimed in claim 1 further comprising recovering the solid metal salt from the nitrogen-rich extract by:

mixing the solid nitrogen-rich extract with a liquid release agent capable of selectively dissolving nitrogen-containing compounds to thereby form a liquid phase comprising the liquid release agent and nitrogen-containing compounds and a solid phase comprising the solid metal salt; and separating the solid metal salt from the liquid phase.

4. A process as claimed in claim 3 wherein the liquid release agent has a dielectric constant of from about 2 to about 8.

5. A process as claimed in claim 1 further comprising recovering the solid metal salt from the nitrogen-rich extract by:

mixing the solid nitrogen-rich extract with a liquid release agent capable of selectively dissolving the metal salt to form a first liquid phase comprising the liquid release agent and dissolved metal salt and a second liquid phase comprising nitrogen-containing compounds;

separating the first liquid phase from the second liquid phase; and vaporizing substantially all of the liquid release agent from the first phase to regenerate the solid metal salt.

6. A process as claimed in claim 1 further comprising recovering the solid metal salt from the nitrogen-rich extract by:

mixing the solid nitrogen-rich extract with a two-phase liquid release agent comprising an aqueous solvent capable of selectively dissolving the metal salt and an organic solvent capable of dissolving nitrogen-containing compounds to thereby form a first liquid phase containing the aqueous solvent and the dissolved metal salt and a second liquid phase containing the organic solvent and nitrogen-containing compounds;

separating the first liquid phase from the second liquid phase; and vaporizing substantially all of the aqueous solvent of the first liquid phase to regenerate the solid metal salt.

7. A process as claimed in claim 1 further comprising:

recovering non-nitrogen-containing compounds entrained in the solid nitrogen rich extract by:

contacting the solid nitrogen-rich extract with a solvent capable of selectively dissolving non-nitrogen-containing compounds;

separating the solvent and dissolved non-nitrogen-containing compounds from the remaining solid nitrogen-rich extract; and distilling the solvent and dissolved non-nitrogen-containing compounds sufficiently to vaporize at least a portion of the solvent to thereby form a residue comprising non-nitrogen-containing compounds; and adding the recovered non-nitrogen-containing compounds to the nitrogen-lean hydrocarbon liquid.

8. A process as claimed in claim 7 wherein the solvent has a dielectric constant of no more than about 2.

9. A process as claimed in claim 8 wherein the solvent is pentane.

10. A process for reducing the nitrogen content of shale oil comprising:

contacting shale oil feed with a solid extraction agent comprising at least one solid metal salt capable of selectively removing nitrogen-containing compounds from shale oil for a time sufficient to form a nitrogen-lean shale oil raffinate and a solid nitrogen-rich extract;

separating the shale oil raffinate from the solid extract;

mixing the solid nitrogen-rich extract with a solvent capable of selectively dissolving non-nitrogen-containing compounds for a time sufficient to dissolve substantially all non-nitrogen-containing compounds entrained by the nitrogen-rich extract to thereby form a liquid phase consisting essentially of solvent and non-nitrogen-containing compounds and a solid phase consisting essentially of the metal salt and nitrogen-containing compounds;

separating the liquid phase from the solid phase;

removing the solvent from the non-nitrogen-containing compounds; and combining the non-nitrogen-containing compounds with the shale oil raffinate.

11. A process as claimed in claim 10 wherein the extraction agent comprises at least one metal salt selected from the group consisting of cobalt molybdate, cobalt metaborate, the halides of copper, nickel, cobalt, manganese, chromium, vanadium, niobium, zirconium, molybdenum, thorium and uranium, and the nitrates, sulfates and tetrafluoroborates of copper, zinc, nickel, cobalt, iron, manganese, chromium, vanadium, niobium, zirconium, molybdenum, thorium and uranium.

12. A process as claimed in claim 10 wherein the extraction agent comprises $CuCl_2.xH_2O$ wherein x is from 0 to 2.

13. A process as claimed in claim 10 wherein the nitrogen content of the shale oil raffinate is no more than about 3,000 ppm.

14. A process as claimed in claim 10 wherein the shale oil raffinate is separated from the solid extract by decanting.

15. A process as claimed in claim 10 wherein the solvent comprises a dielectric constant from no more than about 2.

16. A process as claimed in claim 10 wherein the solvent comprises pentane.

17. A process as claimed in claim 10 wherein the extraction agent comprises at least one metal salt selected from the group consisting of the phosphate and phosphate derivatives of zirconium and the copper II exchanged counterparts thereof.

18. A process as claimed in claim 10 wherein the extraction agent comprises at least one metal salt selected from the group consisting of the substituted and non-substituted acetates, carboxylates, and acetylacetonates of copper, zinc, nickel, cobalt, iron, manganese, chromium, vanadium, niobium, zirconium, molybdenum, thorium and uranium.

19. A process for reducing the nitrogen content of shale oil comprising:

contacting the shale oil with a solid metal salt capable of selectively removing nitrogen-containing compounds from shale oil for a time sufficient to form a nitrogen lean shale oil raffinate and a nitrogen-rich solid extract;

separating the shale oil raffinate from the solid extract;

contacting the solid extract with a solvent capable of selectively dissolving nitrogen-containing compounds for a time sufficient to dissolve substantially all of the nitrogen-containing compounds in the solid extract to thereby form a liquid phase comprising the solvent and nitrogen-containing compounds and a solid phase comprising the solid metal salt;

separating the liquid phase from the solid phase; and recovering the solvent from the liquid phase.

20. A process as claimed in claim 19 wherein the solid metal salt comprises at least one metal salt selected from the group consisting of cobalt molybdate, cobalt metaborate, the halides of copper, nickel, cobalt, manganese, chromium, vanadium, niobium, zirconium, molybdenum, thorium and uranium, and the nitrates, sulfates and tetrafluoroborates of copper, zinc, nickel, cobalt, iron, manganese, chromium, vanadium, niobium, zirconium, molybdenum, thorium and uranium.

21. A process as claimed in claim 19 wherein the solid metal salt comprises $CuCl_2.xH_2O$ wherein x is from 0 to 2.

22. A process as claimed in claim 19 wherein the solvent is recovered by distilling the liquid phase sufficiently to form a distillate consisting essentially of solvent.

23. A process as claimed in claim 19 wherein the solvent has a dielectric constant of from about 2 to about 8.

24. A process as claimed in claim 19 wherein the solid metal salt comprises at least one metal salt selected from the group consisting of the phosphate and phosphate derivatives of zirconium and the copper II exchanged counterparts thereof.

25. A process as claimed in claim 19 wherein the solid metal salt comprises at least one metal salt selected from the group consisting of the substituted and non-substituted acetates, carboxylates, and acetylacetonates of copper, zinc, nickel, cobalt, iron, manganese, chromium, vanadium, niobium, zirconium, molybdenum, thorium and uranium.

26. A process for reducing the nitrogen content of shale oil comprising:

contacting shale oil with an extraction agent comprising at least one solid metal salt capable of selectively removing nitrogen-containing compounds from shale oil for a time sufficient to remove at least a portion of the nitrogen-containing compounds from the shale oil to thereby form a nitrogen lean shale oil raffinate and a high-nitrogen extract;

separating the high-nitrogen extract from the shale oil raffinate;

washing the high-nitrogen extract with a solvent capable of selectively dissolving non-nitrogen-containing compounds sufficiently to dissolve substantially all of the non-nitrogen-containing compounds entrained in the extract to thereby form a solvent wash comprising the solvent and non-nitrogen-containing compounds and a high-nitrogen solid extract comprising the metal salt and nitrogen-containing compounds;

separating the solvent wash from the high-nitrogen solid extract;

distilling the solvent wash sufficiently to form a distillate comprising at least a portion of the solvent substantially free of non-nitrogen-containing compounds and a bottoms comprising non-nitrogen-containing compounds;

combining the bottoms and the raffinate;

mixing the high-nitrogen solid extract with a liquid release agent capable of selectively dissolving nitrogen-containing compounds to thereby form a liquid phase comprising the liquid release agent and nitrogen-containing compounds and a solid phase comprising the metal salt;

separating the liquid phase from the solid phase; and recovering the liquid release agent from the liquid phase.

27. A process as claimed in claim 26 wherein the solvent has a dielectric constant of no more than about 2.

28. A process as claimed in claim 26 wherein the liquid release agent has a dielectric constant of from about 2 to about 8.

29. A process as claimed in claim 26 wherein the liquid release agent is recovered by distilling the liquid phase sufficiently to form a distillate consisting essentially of the liquid release agent.

30. A process for reducing the nitrogen content of shale oil comprising:

contacting shale oil with an extraction agent comprising at least one solid metal salt selected from:

the group consisting of cobalt molybdate, cobalt metaborate, the halides, nitrates, sulfates and tetronfluoroborates of copper, zinc, nickel, cobalt, iron, manganese, chromium, vanadium, niobium, zirconium, molybdenum, thorium and uranium; or the group consisting of the phosphate and phosphate derivatives of zirconium and the copper II exchanged counterparts thereof; or the group consisting of the substituted and non-substituted acetates, carboxylates and acetylacetonates of copper, zinc, nickel, cobalt, iron, manganese, chromium, vanadium, niobium, zirconium, molybdenum, thorium and uranium, for a time sufficient to remove at least a portion of the nitrogen-containing compounds from the shale oil to thereby form a nitrogen-lean shale oil raffinate and a high-nitrogen extract;

separating the high-nitrogen extract from the shale oil raffinate;

washing the high-nitrogen extract with a first solvent having a dielectric constant of no more than about 2 for dissolving non-nitrogen-containing compounds entrained in the extract to thereby form a solvent wash comprising the first solvent and non-nitrogen containing compounds dissolved therein, and disstilling the solvent wash sufficiently to form a distillate comprising the first solvent substantially free of non-nitrogen-containing compounds and a bottoms comprising non-nitrogen-containing compounds;

combining the bottoms and the raffinate;

mixing the high-nitrogen solid extract with a second solvent having a dielectric constant of from about 2 to about 8 to thereby form a solvent phase comprising the second solvent and nitrogen-containing compounds and a solid phase comprising the metal salt;

separating the solvent phase from the solid phase; and distilling the solvent phase sufficiently to form a distillate comprising the second solvent substantially free of nitrogen-containing compounds.

31. A process as claimed in claim 30 wherein the solid metal salt comprises cupric chloride.

32. A process as claimed in claim 30 wherein the nitrogen content of the shale oil raffinate is no more than about 3,000 ppm.

33. A process for reducing the nitrogen content of shale oil comprising:

contacting shale oil with a solid extraction agent comprising cupric chloride for a time sufficient to remove at least a portion of the nitrogen-containing compounds from the shale oil to thereby form a nitrogen-lean shale oil raffinate and a high-nitrogen extract;

decanting the nitrogen-lean raffinate from the high-nitrogen extract;

washing the high-nitrogen extract with a first solvent having a dielectric constant of no more than about 2 sufficiently to dissolve non-nitrogen-containing compounds entrained in the extract to thereby form a solvent wash comprising the first solvent and non-nitrogen-containing compounds and a high-nitrogen solid extract comprising the metal salt and nitrogen-containing compounds;

decanting the solvent wash from the high-nitrogen solid extract;

distilling the solvent wash sufficiently to form a distillate comprising the first solvent substantially free of non-nitrogen-containing compounds and a bottoms comprising non-nitrogen-containing compounds;

combining the bottoms and the raffinate;

mixing the high-nitrogen solid extract with a second solvent having a dielectric constant from about 2 to about 8 to thereby form a solvent phase comprising the second solvent and nitrogen-containing compounds and a solid phase comprising cupric chloride;

separating the solvent phase from the solid phase; and distilling the solvent phase sufficiently to form a distillate consisting essentially of the second solvent.

34. A process as claimed in claim 33 wherein the first solvent is pentane.

35. A process as claimed in claim 33 wherein the second solvent is selected from the group consisting of tetrahydrofuran, toluene, acetic acid, methyl acetate and ethyl acetate.

36. A process for reducing the nitrogen content of hydrocarbon liquids comprising:

mixing a hydrocarbon liquid containing nitrogen-containing compounds with at least one metal salt selected from the group consisting of the phosphate and phosphate derivatives of zirconium and the copper II exchanged counterparts thereof for a time sufficient for at least a portion of the nitrogen-containing compounds to be extracted from the hydrocarbon liquid by the solid compound to thereby form a nitrogen-lean hydrocarbon liquid and a solid nitrogen-rich extract; and separating the solid nitrogen-rich extract from the nitrogen-lean hydrocarbon liquid.

37. A process for reducing the nitrogen content of hydrocarbon liquids comprising:

mixing a hydrocarbon liquid containing nitrogen-containing compounds with at least one metal salt selected from the group consisting of the substituted and non-substituted acetates, carboxylates and acetylacetonates of copper, zinc, nickel, cobalt, iron, magnesium, chromium, vanadium, niobium, zirconium, molybdenum, thorium and uranium for a time sufficient for at least a portion of the nitrogen-containing compounds to be extracted from the hydrocarbon liquid by the solid compound to thereby form a nitrogen-lean hydrocarbon liquid and a solid nitrogen-rich extract; and separating the solid nitrogen-rich extract from the nitrogen-lean hydrocarbon liquid.

* * * * *